US006386124B1

(12) United States Patent
Norquist

(10) Patent No.: US 6,386,124 B1
(45) Date of Patent: May 14, 2002

(54) WASTE TREATMENT SYSTEM

(76) Inventor: Dale T. Norquist, 223 S. Agate, Anaheim, CA (US) 92804

( * ) Notice: Subject to any disclaimer, the term of this patent is extended or adjusted under 35 U.S.C. 154(b) by 0 days.

(21) Appl. No.: 09/827,782

(22) Filed: Apr. 6, 2001

(51) Int. Cl.[7] ..... F23G 5/02; F23G 5/44; F23G 5/10

(52) U.S. Cl. ..... 110/223; 110/101 R; 110/219; 110/221; 110/228; 110/250; 110/255; 110/108

(58) Field of Search ..... 110/101 R, 105, 110/106, 109, 110, 342, 218, 219, 223, 221, 227, 228, 238, 226, 250, 255, 108

(56) References Cited

U.S. PATENT DOCUMENTS

| | | | | | |
|---|---|---|---|---|---|
| 1,753,050 | A | * | 4/1930 | Hughes | 110/108 |
| 1,783,092 | A | * | 11/1930 | Lewis | 110/108 |
| 2,932,713 | A | * | 4/1960 | Powers | 219/19 |
| 3,027,854 | A | * | 4/1962 | Akerlund | 110/15 |
| 3,303,947 | A | * | 2/1967 | Reilly | 214/3 |
| 3,559,823 | A | * | 2/1971 | Ostrin | 214/23 |
| 3,695,432 | A | * | 10/1972 | McCrink | 210/67 |
| 3,855,950 | A | * | 12/1974 | Hughes et al. | 110/8 C |
| 4,009,667 | A | | 3/1977 | Tyler et al. | |
| 4,084,521 | A | * | 4/1978 | Herbold et al. | 110/242 |
| 4,147,114 | A | | 4/1979 | Holmes | |
| 4,423,311 | A | | 12/1983 | Varney, Sr. | |
| 4,483,257 | A | * | 11/1984 | den Otter | 110/218 |
| 4,606,283 | A | * | 8/1986 | DesOrmeaux et al. | 110/250 |
| 4,643,108 | A | * | 2/1987 | Singelyn et al. | 110/228 |
| 4,728,780 | A | | 3/1988 | Uchino | |
| 4,759,300 | A | * | 7/1988 | Hansen et al. | 110/229 |
| 5,325,795 | A | * | 7/1994 | Nelson et al. | 110/236 |
| 5,372,077 | A | * | 12/1994 | Yen et al. | 110/233 |
| 5,411,714 | A | * | 5/1995 | Wu et al. | 422/232 |
| 5,454,333 | A | * | 10/1995 | Von Seebach et al. | 110/101 R |
| 5,609,829 | A | | 3/1997 | Lucas et al. | |
| 5,615,627 | A | * | 4/1997 | Marr | 110/346 |
| 5,634,414 | A | * | 6/1997 | Camacho | 110/346 |
| 5,657,706 | A | * | 8/1997 | Liagre et al. | 110/250 |
| 5,660,124 | A | * | 8/1997 | Doncer | 110/227 |
| 5,806,441 | A | * | 9/1998 | Chung | 110/185 |
| 5,848,728 | A | * | 12/1998 | Ricciardi et al. | 222/63 |
| 5,902,465 | A | | 5/1999 | Pang | |
| 6,193,925 | B1 | * | 2/2001 | Weber et al. | 264/509 |
| 6,276,286 | B1 | * | 8/2001 | Williams et al. | 110/110 |

* cited by examiner

*Primary Examiner*—Ira S. Lazarus
*Assistant Examiner*—K. B. Rinehart

(57) ABSTRACT

A waste treatment system for solidifying and increasing the speed at which manure would dry. The waste treatment system includes support members; and also includes an elongate tubular member being mounted upon the support members and having an inlet end and an outlet end and having a bore being disposed therethrough; and further includes a waste holding/compressing assembly being mounted to the elongate tubular member; and also includes an incineration/discharge assembly being disposed in and about the elongate tubular member for incinerating waste material.

8 Claims, 3 Drawing Sheets

WASTE TREATMENT SYSTEM

BACKGROUND OF THE INVENTION

1. Field of the Invention

The present invention relates to an animal waste treatment system and more particularly pertains to a new waste treatment system for solidifying and increasing the speed at which manure would dry.

2. Description of the Prior Art

The use of an animal waste treatment system is known in the prior art. More specifically, an animal waste treatment system heretofore devised and utilized are known to consist basically of familiar expected and obvious structural configurations, notwithstanding the myriad of designs encompassed by the crowded prior art which have been developed for the fulfillment of countless objectives and requirements.

Known prior art includes U.S. Pat. No. 4,009,667; U.S. Pat. No. 4,147,114; U.S. Pat. No. 4,423,311; U.S. Pat. No. 4,728,780; U.S. Pat. No. 5,609,829: and U.S. Pat. No. 5,902,465.

While these devices fulfill their respective, particular objectives and requirements, the aforementioned patents do not disclose a new waste treatment system. The inventive device includes support members; and also includes an elongate tubular member being mounted upon the support members and having an inlet end and an outlet end and having a bore being disposed therethrough; and further includes a waste holding/compressing assembly being mounted to the elongate tubular member; and also includes an incineration/discharge assembly being disposed in and about the elongate tubular member for incinerating waste material.

In these respects, the waste treatment system according to the present invention substantially departs from the conventional concepts and designs of the prior art, and in so doing provides an apparatus primarily developed for the purpose of solidifying and increasing the speed at which manure would dry.

SUMMARY OF THE INVENTION

In view of the foregoing disadvantages inherent in the known types of animal waste treatment system now present in the prior art, the present invention provides a new waste treatment system construction wherein the same can be utilized for solidifying and increasing the speed at which manure would dry.

The general purpose of the present invention, which will be described subsequently in greater detail, is to provide a new waste treatment system which has many of the advantages of the animal waste treatment system mentioned heretofore and many novel features that result in a new waste treatment system which is not anticipated, rendered obvious, suggested, or even implied by any of the prior art animal waste treatment system, either alone or in any combination thereof.

To attain this, the present invention generally comprises support members; and also includes an elongate tubular member being mounted upon the support members and having an inlet end and an outlet end and having a bore being disposed therethrough; and further includes a waste holding/compressing assembly being mounted to the elongate tubular member; and also includes an incineration/discharge assembly being disposed in and about the elongate tubular member for incinerating waste material.

There has thus been outlined. rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new waste treatment system which has many of the advantages of the animal waste treatment system mentioned heretofore and many novel features that result in a new waste treatment system which is not anticipated rendered obvious, suggested, or even implied by any of the prior art animal waste treatment system, either alone or in any combination thereof.

It is another object of the present invention to provide a new waste treatment system which may be easily and efficiently manufactured and marketed.

It is a further object of the present invention to provide a new waste treatment system which is of a durable and reliable construction.

An even further object of the present invention is to provide a new waste treatment system which is susceptible of a low cost of manufacture with regard to both materials and labor, and which accordingly is then susceptible of low prices of sale to the consuming public, thereby making such waste treatment system economically available to the buying public.

Still yet another object of the present invention is to provide a new waste treatment system which provides in the apparatuses and methods of the prior art some of the advantages thereof, while simultaneously overcoming some of the disadvantages normally associated therewith.

Still another object of the present invention is to provide a new waste treatment system for solidifying and increasing the speed at which manure would dry.

Yet another object of the present invention is to provide a new waste treatment system which includes support members; and also includes an elongate tubular member being mounted upon the support members and having an inlet end and an outlet end and having a bore being disposed therethrough; and further includes a waste holding/compressing assembly being mounted to the elongate tubular member; and also includes an incineration/discharge assembly being disposed in and about the elongate tubular member for incinerating waste material.

Still yet another object of the present invention is to provide a new waste treatment system that effectively converts solid waste from livestock into inert ash material for safe distribution upon fields.

Even still another object of the present invention is to provide a new waste treatment system that more easily converts solid waste into inert ash than that of the conventional prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
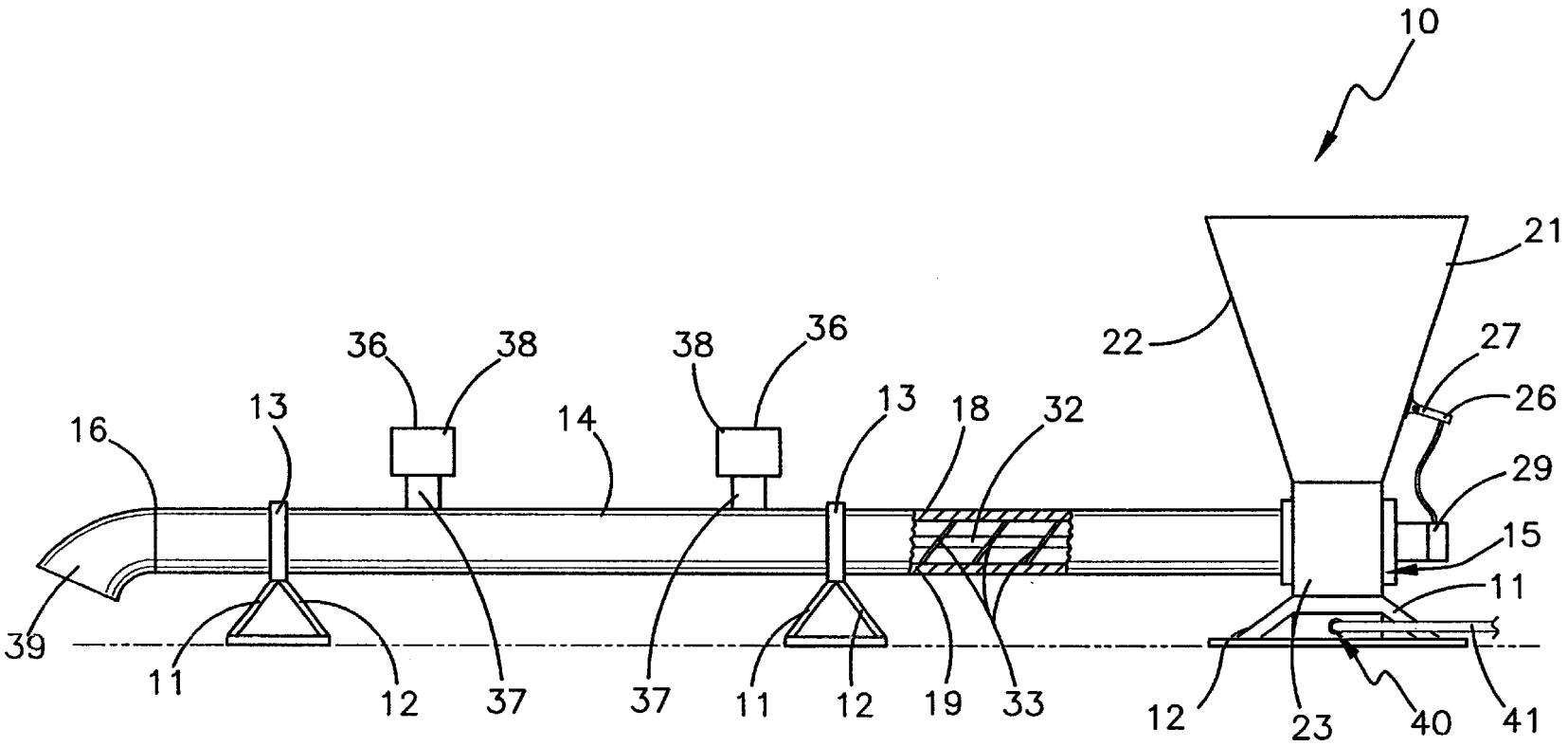
FIG. 1 is a side elevational view of a new waste treatment system according to the present invention.
Figure 2:
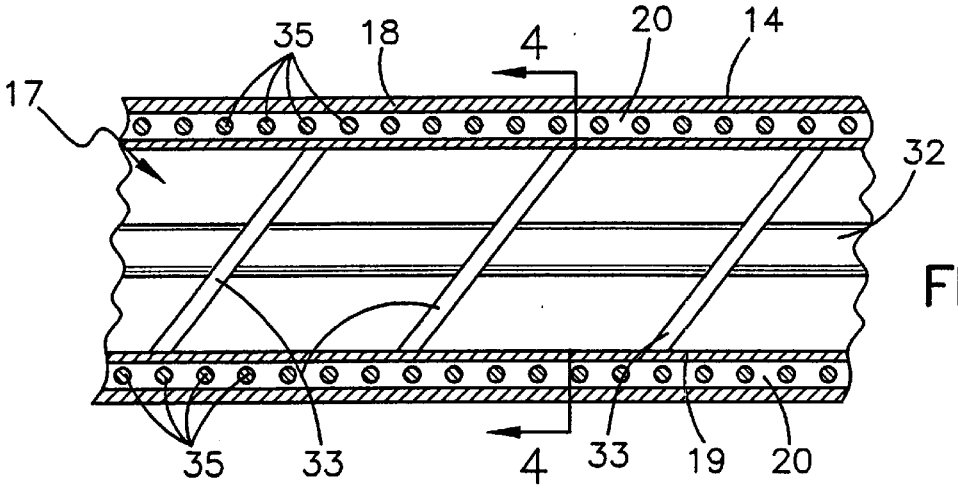
FIG. 2 is a detailed cross-sectional view of a portion of the elongate tubular member of the present invention.
Figure 3:
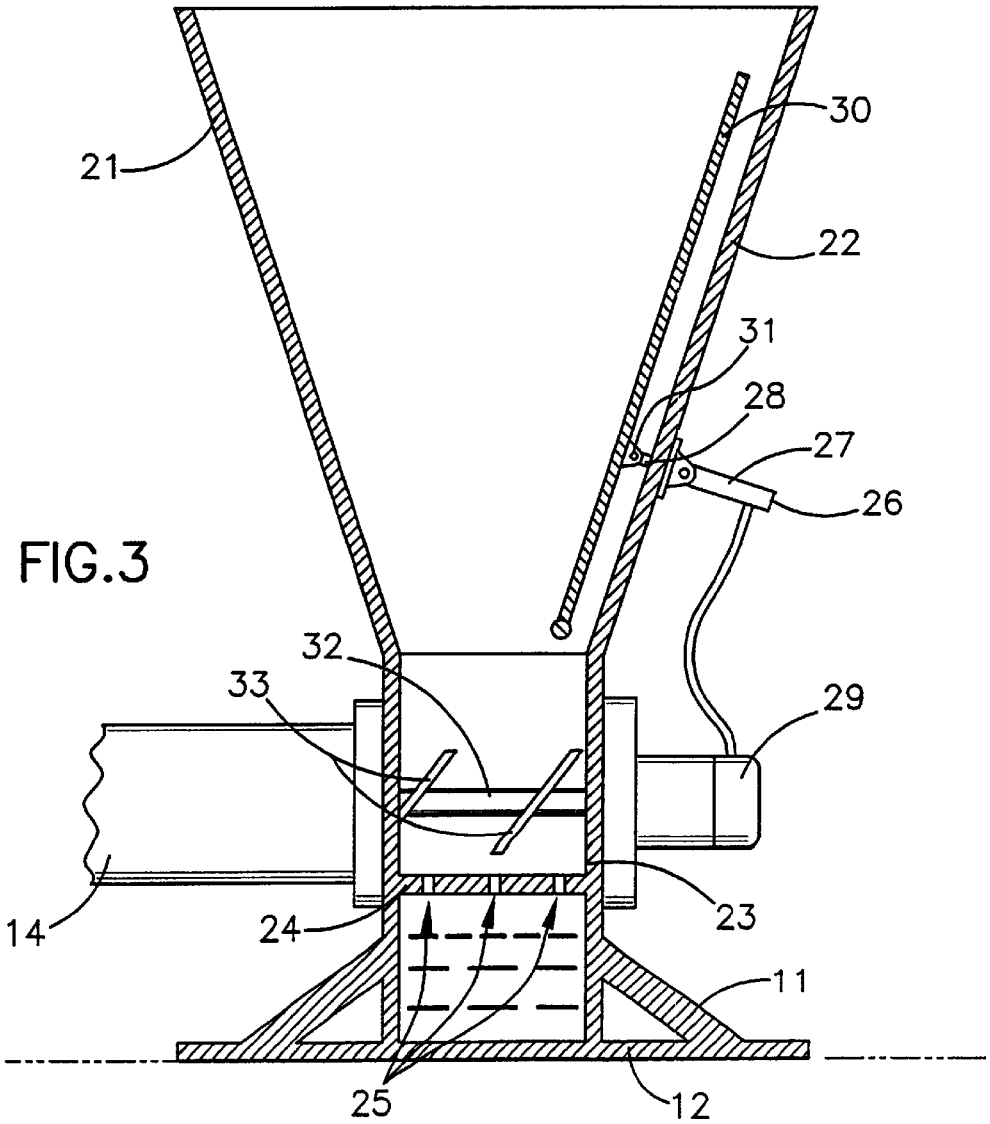
FIG. 3 is a detailed cross-sectional view of the hopper of the present invention.
Figure 4:
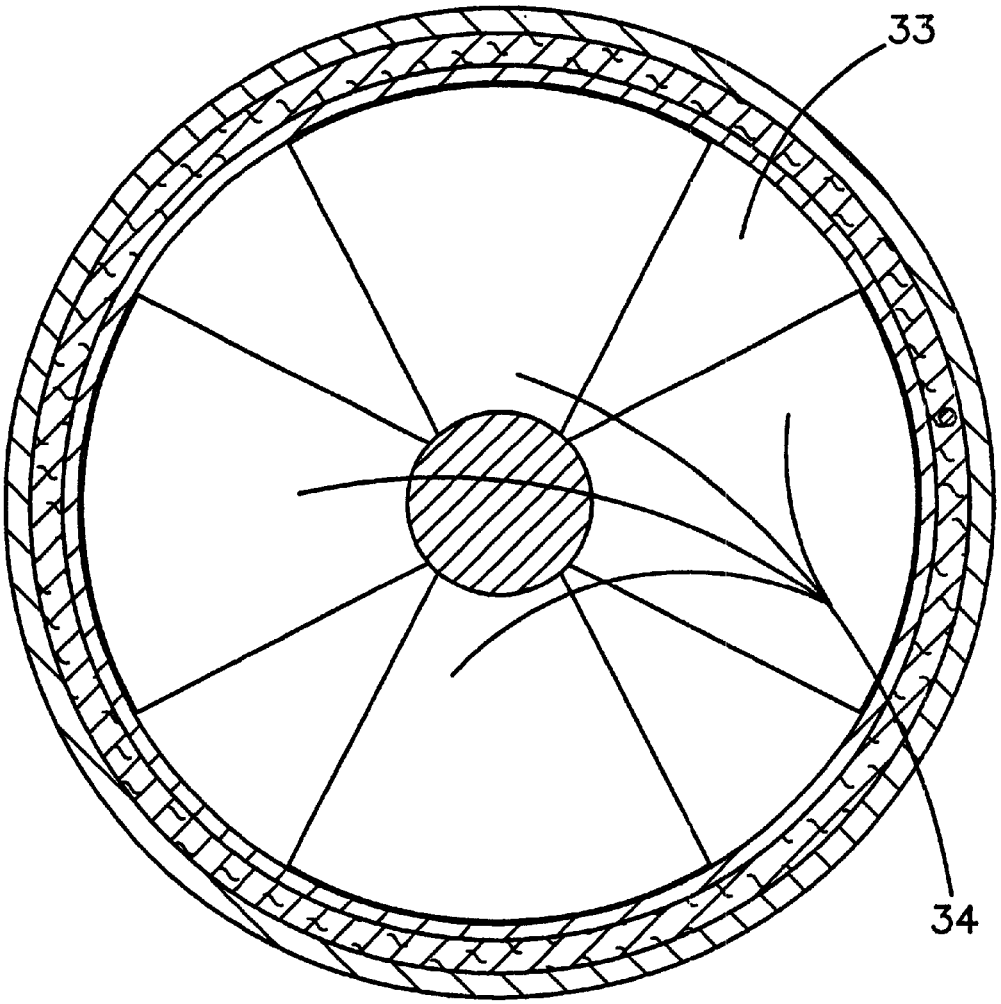
FIG. 4 is a detailed end view of the auger of the present invention.

With reference now to the drawings, and in particular to FIGS. 1 through 4 thereof, a new waste treatment system embodying the principles and concepts of the present invention and generally designated by the reference numeral 10 will be described.

As best illustrated in FIGS. 1 through 4, the waste treatment system 10 generally comprises support members 11 being stands for resting upon a ground. Each of the stands 11 includes a base member 12 and a bracket member 13 being conventionally mounted upon the base member 12. An elongate tubular member 14 is conventionally mounted upon the support members 11 and has an inlet end 15 and an outlet end 16 and has a bore 17 being disposed therethrough. The elongate tubular member 14 includes an inner wall 19 and an outer wall 18 with insulating material 20 being conventionally disposed between the inner and outer walls 18,19. The elongate tubular member 14 is mounted to the bracket members 13 of the support members 11, with the elongate tubular member 14 having a length of approximately 30 to 40 feet and having a diameter of approximately 1 to 3 feet.

A waste holding/compressing assembly is conventionally mounted to the elongate tubular member 14. The waste holding/compressing assembly includes a funnel-shaped hopper 21 being mounted upon the inlet end 15 of the elongate tubular member 14, and also includes a hydraulic ram 26 being conventionally mounted to the funnel-shaped hopper 21, and further includes a press member 30,31 being attached to the hydraulic ram 26 and being movably disposed in the funnel-shaped hopper 21 for compressing the waste material disposed in the funnel-shaped hopper 21; and also includes a hydraulic pump 29 being connected with wires to the hydraulic ram 26 for the energizing thereof. The funnel-shaped hopper 21 includes an upper portion 22 and a lower portion 23 which extends laterally through the elongate tubular member 14. The lower portion 23 has an intermediate wall 24 being conventionally disposed therein and having a plurality of holes 25 being disposed therethrough for allowing liquid which is pressed out of the waste material to drain out of the funnel-shaped hopper 21 through a drainage hole 40 in the lower portion 23 of the funnel-shaped hopper and through a drainage conduit 41 which is conventionally attached to and over the drainage hole 40. The hydraulic ram 26 includes a hydraulic cylinder 27 being conventionally attached to an exterior of the upper portion 22 of the funnel-shaped hopper 21, and also includes a piston 28 being movably disposed in and from the hydraulic cylinder 27 and being disposed through a wall of the upper portion 22 of the funnel-shaped hopper 21. The press member, 30,31 includes a plate member 30 and a bracket 31 being conventionally attached to the plate member 30 and being pivotally attached to the piston 28. The plate member 30 is movable toward and away from an opposed wall of the upper portion 22 of the funnel-shaped hopper 21.

An incineration/discharge assembly is disposed in and about the elongate tubular member 14 for incinerating waste material. The incineration/discharge assembly includes an auger 32 being rotatably and conventionally disposed in the bore 17 of the elongate tubular member 14 and has an end portion being rotatably disposed through the lower portion 23 of the funnel-shaped hopper 21, and also includes heating elements 35 being disposed along a length of the elongate tubular member 14 and between the inner and outer walls 18,19 of the elongate tubular member 14, and further includes catalytic converting vent members 36 being conventionally disposed upon an exterior of the outer wall 18 and being extended through the outer wall 18 and into the bore 17 of the elongate tubular member 14, and also includes a discharge chute 39 being conventionally attached to the outlet end 16 of the elongate tubular member 14. The auger 32 includes flighting members 33 each having a plurality notches 34 disposed therethrough for slowing movement of the waste material through the elongate tubular member 14. Each of the catalytic converting vent members 36 includes a pipe member 37 and a shroud 38 being conventionally disposed upon the pipe member 37 with the flighting members 33 being spaced-apart at approximately 5 to 8 foot intervals.

In use, the user would load the funnel-shaped hopper 21 with solid waste material from animals such as livestock and would energize the hydraulic ram 26 which would move the plate member 30 to compress the solid waste material to squeeze out the liquid from the waste material. The waterless waste material would then be moved through the bore 17 of the elongate tubular member 14 with the auger 32, and as the waste material passes through the elongate tubular member 14, the heating elements 35 would further dry out and incinerate the solid waste material at temperatures of 800 degrees Fahrenheit to form inert ash material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A waste treatment system comprising:

support members;

an elongate tubular member being mounted upon said support members and having an inlet end and an outlet end and having a bore being disposed therethrough;

a waste holding/compressing assembly being mounted to said elongate tubular member; and an incineration/discharge assembly being disposed in and about said elongate tubular member for incinerating waste material;

wherein said support members are stands for resting upon a ground, each of said stands including a base member and a bracket member being mounted upon said base member;

wherein said elongate tubular member includes an inner wall and an outer wall with insulating material being disposed between said inner and outer walls, said elongate tubular member being mounted to said bracket members of said support members; and wherein said waste holding/compressing assembly includes a funnel-shaped hopper being mounted upon said inlet end of said elongate tubular member, and also includes a hydraulic ram being mounted to said funnel-shaped hopper, and further includes a press member being attached to said hydraulic ram and being movably disposed in said funnel-shaped hopper for compressing the waste material disposed in said funnel-shaped hopper; and also includes a hydraulic pump being connected to said hydraulic ram for the energizing thereof.

2. A waste treatment system as described in claim 1, wherein said funnel-shaped hopper includes an upper portion and a lower portion which extends laterally through said elongate tubular member, said lower portion having an intermediate wall being disposed therein and having a plurality of holes disposed therethrough for allowing liquid which is pressed out of the waste material to drain out of said funnel-shaped hopper through a drainage hole in said lower portion of said funnel-shaped hopper and through a drainage conduit which is attached to and over said drainage hole.

3. A waste treatment system as described in claim 1, wherein said hydraulic ram includes a hydraulic cylinder being attached to an exterior of said upper portion of said funnel-shaped hopper, and also includes a piston being movably disposed in and from said hydraulic cylinder and being disposed through a wall of said upper portion of said funnel-shaped hopper.

4. A waste treatment system as described in claim 3, wherein said press member includes a plate member and a bracket being attached to said plate member and being pivotally attached to said piston, said plate being movable toward and away from an opposed wall of said-upper portion of said funnel-shaped hopper.

5. A waste treatment system as described in claim 2, wherein said incineration/discharge assembly includes an auger being rotatably disposed in said bore of said elongate tubular member and having an end portion being rotatably disposed through said lower portion of said funnel-shaped hopper, and also includes heating elements being disposed along a length of said elongate tubular member and between said inner and outer walls of said elongate tubular member, and further includes catalytic converting vent members being disposed upon an exterior of said outer wall and being extended through said outer wall and into said bore of said elongate tubular member, and also includes a discharge chute being attached to said outlet end of said elongate tubular member.

6. A waste treatment system as described in claim 5, wherein said auger includes flighting members each having a plurality notches therethrough for slowing movement of the waste material through the elongate tubular member.

7. A waste treatment system as described in claim 5, wherein each of said catalytic converting vent members includes a pipe member and a shroud being disposed upon said pipe member.

8. A waste treatment system comprising:

support members being stands for resting upon a ground, each of said stands including a base member and a bracket member being mounted upon said base member;

an elongate tubular member being mounted upon said support members and having an inlet end and an outlet end and having a bore being disposed therethrough said elongate tubular member including an inner wall and an outer wall with insulating material being disposed between said inner and outer walls, said elongate tubular member being mounted to said bracket members of said support members, said elongate tubular member having a length of approximately 30 to 40 feet and having a diameter of approximately 1 to 3 feet.

a waste holding/compressing assembly being mounted to said elongate tubular member, said waste holding/compressing assembly including a funnel-shaped hopper being mounted upon said inlet end of said elongate tubular member, and also including a hydraulic ram being mounted to said funnel-shaped hopper, and further including a press member being attached to said hydraulic ram and being movably disposed in said funnel-shaped hopper for compressing the waste material disposed in said funnel-shaped hopper; and also including a hydraulic pump being connected to said hydraulic ram for the energizing thereof, said funnel-shaped hopper including an upper portion and a lower portion which extends laterally through said elongate tubular member, said lower portion having an intermediate wall being disposed therein and having a plurality of holes disposed therethrough for allowing liquid which is pressed out of the waste material to drain out of said funnel-shaped hopper through a drainage hole in said lower portion of said funnel-shaped hopper and through a drainage conduit which is attached to and over said drainage hole, said hydraulic ram including a hydraulic cylinder being attached to an exterior of said upper portion of said funnel-shaped hopper, and also including a piston being movably disposed in and from said hydraulic cylinder and being disposed through a wall of said upper portion of said funnel-shaped hopper, said press member including a plate member and a bracket being attached to said plate member and being pivotally attached to said piston, said plate being movable toward and away from an opposed wall of said upper portion of said funnel-shaped hopper; and an incineration/discharge assembly being disposed in and about said elongate tubular member for incinerating waste material, said incineration/discharge assembly including an auger being rotatably disposed in said bore of said elongate tubular member and having an end portion being rotatably disposed through said lower portion of said funnel-shaped hopper, and also including heating elements being disposed along a length of said elongate tubular member and between said inner and outer walls of said elongate tubular member, and further including catalytic converting vent members being disposed upon an exterior of said outer wall and being extended through said outer wall and into said bore of said elongate tubular member, and also including a discharge chute being attached to said outlet end of said elongate tubular member, said auger including flighting members each having a plurality notches therethrough for slowing movement of the waste material through the elongate tubular member, each of said catalytic converting vent members including a pipe member and a shroud being disposed upon said pipe member, said flighting members being spaced apart at approximately 5 to 8 foot intervals.

* * * * *